United States Patent [19]

Kiefer

[11] 4,097,947

[45] Jul. 4, 1978

[54] INFLATABLE WEARABLE FLOTATION DEVICE

[75] Inventor: James E. Kiefer, Olivenhain, Calif.

[73] Assignee: SoniForm Incorporated, La Mesa, Calif.

[21] Appl. No.: 788,004

[22] Filed: Apr. 15, 1977

[51] Int. Cl.[2] ..... B63C 9/16

[52] U.S. Cl. ..... 9/338; 9/342

[58] Field of Search ..... 9/329, 330, 333, 336–342, 9/345

[56] References Cited

U.S. PATENT DOCUMENTS

| | | | |
|---|---|---|---|
| 3,117,326 | 1/1964 | Bernhardt et al. | 9/338 |
| 3,441,964 | 5/1969 | Koch et al. | 9/338 |
| 3,931,657 | 1/1976 | Jones | 9/342 |

*Primary Examiner*—Trygve M. Blix
*Assistant Examiner*—Stuart M. Goldstein
*Attorney, Agent, or Firm*—Robert E. Geauque

[57] ABSTRACT

An inflatable wearable flotation device having flotation material in front and back panels and an inflatable bladder having sections located at said front panels and a collar section positioned over said back panel comprising a bladder section, and fastener means for maintaining said bladder sections flat when fastened and being unfastened by expansion of the bladder sections to permit inflation of the bladder.

8 Claims, 8 Drawing Figures

INFLATABLE WEARABLE FLOTATION DEVICE

BACKGROUND OF THE INVENTION

At present, typical Type III personal flotation devices approved by the U.S. Coast Guard, consist of a vestlike garment which has buoyant material in the back and front panels of the device and without provision for additional buoyancy provided by inflation of the vest. Also, a life jacket has been combined with an inflatable bladder which is selectively filled with a gas, such as air or $CO_2$, for the purpose of providing additional inflation (see U.S. Pat. No. 3,931,657 to Walter C. Jones). It is desirable that when a combination jacket is inflated by the wearer that in addition to the normal performance required of a Type III device, it performs in the same manner as a Type II personal flotation device in that it will turn an unconscious wearer from a face down to a face up position in the water and maintain his head and face out of the water.

This prior combination vest has the disadvantage that the air inflating tube for the bladder is always exterior of the vest so that it could interfere with the wearing of the vest and further, the excessive material of the vest cover which is required for expansion of the vest upon inflation of the bladder is not firmly held in position until inflation. Also, the inflatable collar of the vest is not firmly held in position until inflation and is permitted to flap away from the vest so as to interfere with the activities of the wearer. It also requires that the inflatable bladder be firmly fixed to the outer envelope of the vest.

Another combination device is illustrated in U.S. Pat. No. 3,199,128 to Nojd and is constructed in the form of a jacket vest with sleeves. Such a bulky device will obviously interfere with the wearer's movements in the water. Also, of interest is U.S. Patent to Bernhardt, U.S. Pat. No. 3,117,326 illustrating a neck float restrained by a flap normally secured by snaps and opened automatically upon inflation of the float.

SUMMARY OF THE INVENTION

The personal flotation vest of the present invention utilizes front and back chambers containing a buoyant material, such as closed cell polyethylene or polyvinylchloride (PVC) foam, in addition, the invention utilizes a normally deflated bladder which is located in the two front panels and in a collar across the back of the wearer. When the bladder is inflated, the collar rises up and forms a head support for the wearer. All of the portions of the inflatable bladder are connected together so that they all contain the same pressure when inflated. The bladder is not fixed to the outer envelope of this vest.

The vest is constructed to have minimum interference with the wearer. This is accomplished by using large pleats at the sides of the front chamber covers which allow unrestrained expansion of the chamber covers and of the bladder section in each chamber. The bladder sections are located exteriorly of expanded foam material in each of the front chambers and sufficient material is present in the pleats in the chamber covers to permit the bladders to fully inflate without producing a restricting force against normal breathing of the wearer. The pleats are normally held closed by restraining devices, such as snaps or Velcro, so that the pleats are held out of the way of the wearer during normal use. Upon inflation of the bladder, the restraining devices are automatically opened by the force exerted by the expanding bladder.

The bladder can be inflated either by an oral inflating tube or by a $CO_2$ cartridge and inflating mechanism, both of which are carried by the vest and both of which are covered by the pleats of the chamber covers when the bladder is in the uninflated condition. Thus, the inflating mechanisms are out of the way and not subject to snagging on rigging or other obstructions when the vest is worn without inflation. Only the pull string for the cartridge is exterior of the jacket.

The inflatable collar of the vest is also held to the body of the jacket by restraining devices when the bladder is not inflated and these restraining devices also are automatically opened on inflation. When inflated, the collar containing a section of the bladder rises up behind the head of the wearer, providing support for the head when the wearer is in the water. Because of the fact that the bladder is not attached to the cover of the vest, the bladder can be easily inserted within the front chambers which provides for ease of manufacture and maintenance. In one modification of the invention the bladder can be located outside the front chambers of the vest and directly held to the vest by restraining devices. In this configuration, the bladder is fixed directly to the jacket around the neck and along the zipper front only.

BRIEF DESCRIPTION OF THE PREFERRED EMBODIMENT

Figure 2:
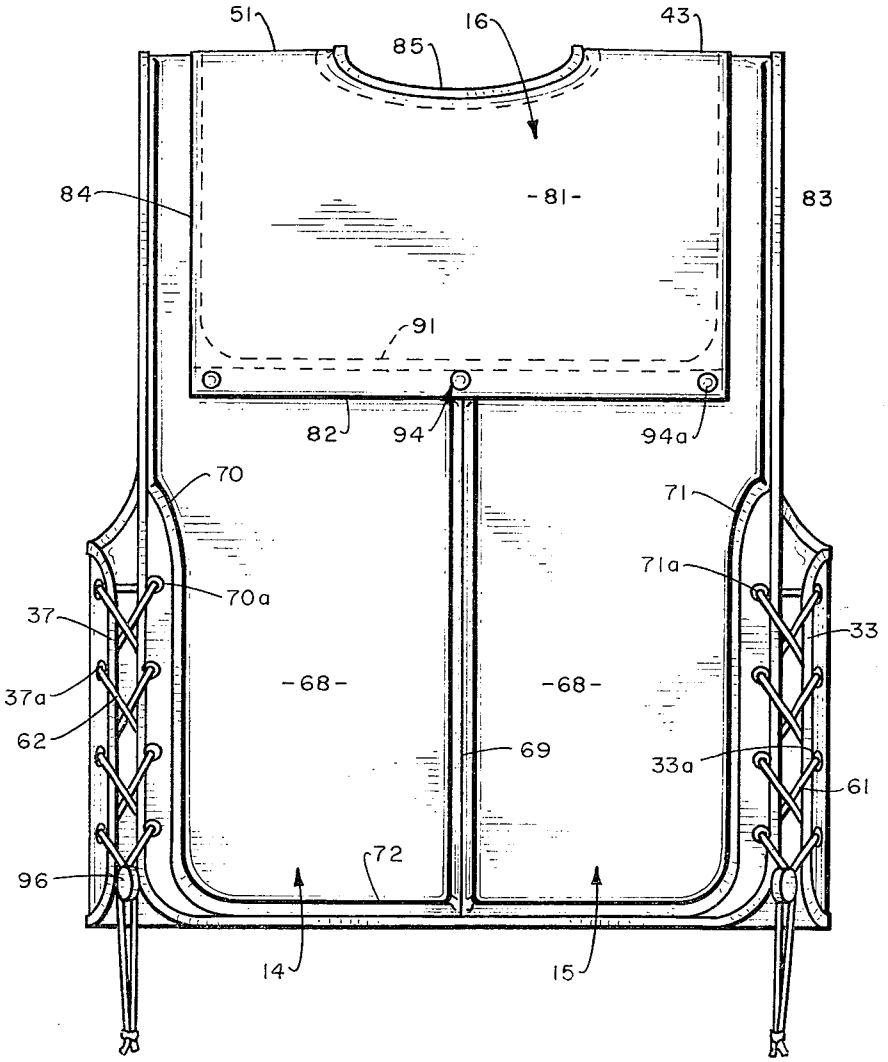
FIG. 2 is a back elevational view of the vest showing the inflatable collar and the tie cords for adjusting the size of the vest
Figure 1:
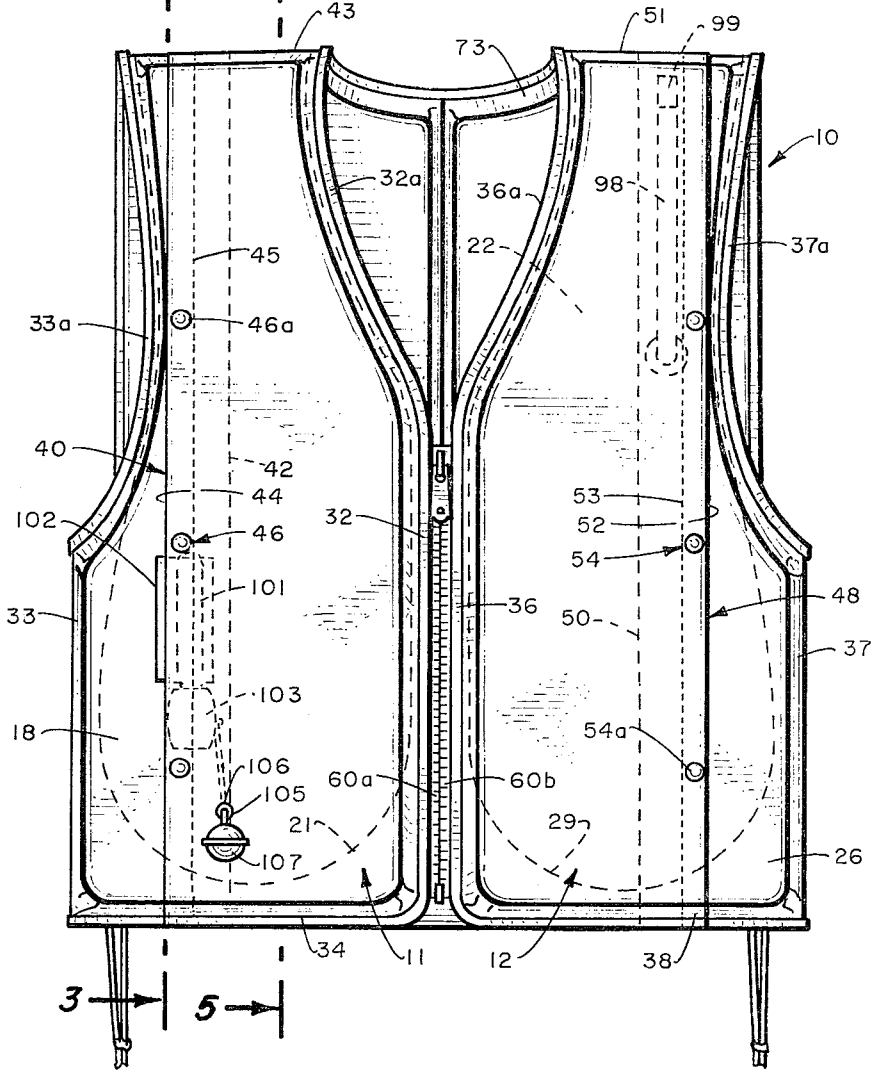
FIG. 1 is a front elevational view of the inflatable life vest of this invention illustrating the front zipper and the expandable pleats.
Figures 6, 7, 8:
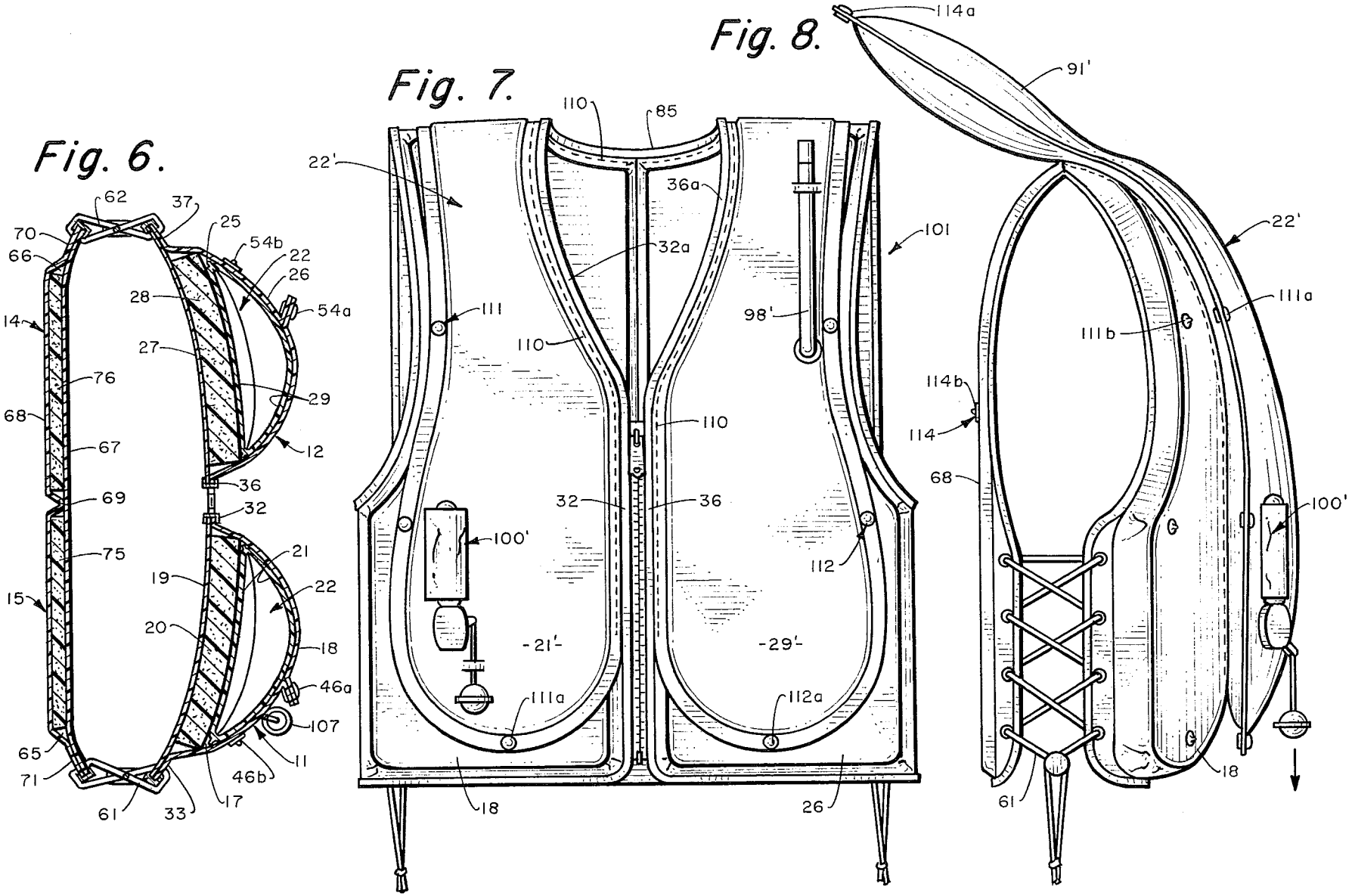
FIG. 6 is a horizontal section along line 6—6 of FIG. 5 illustrating the foam in the front and back chamber of the jacekt.
FIG. 7 is a front elevational view of a modification of the jacket in which the bladder is on the exterior surface of the jacket.
FIG. 8 is a side elevational view of the jacket of FIG. 7 with the bladder inflated.

Referring to FIGS. 1 and 2, the flotation vest 10 of the present invention has a pair of front panels 11 and 12 and a pair of back panels 14 and 15 and a collar 16. Referring to FIG. 6, the front panel 11 comprises a chamber 17 formed between front cover 18 and back cover 19 and the chamber contains flotation foam panel 20 and a leg section 21 of U-shaped bladder 22. In a similar manner, the front panel 12 comprises a chamber 25 formed between front cover 26 and back cover 27 and the chamber contains flotation foam panel 28 and a leg section 29 of the bladder 22.

Covers 18 and 19 are secured together at inside edges 32, outside edges 33 and bottom edges 34. Edge portions 32*a* and 33*a* of edges 32 and 33, respectively, are curved towards one another to form neck and arm openings, respectively. In a similar manner, covers 26 and 27 are secured together at inside edge 36, outside edges 37 and bottom edges 38. Edge portions 36*a* and 37*a* of edges 36 and 37, respectively, are curved towards one another to form neck and arm openings, respectively. The covers 18, 19 and 26, 27 can be formed of fabric which can be sewn together at their edges.

The cover 18 has a pleat 40 formed by inward folding of the cover to line 42 and the pleat is held at the top by seam 43 and is secured at the bottom to the edges 34. Outside open edge 44 of the pleat is stitched at seam 45 and carries a plurality of spaced snap members 46 each of which consists of a female portion 46*a* receiving a male portion 46*b* attached to cover 18 below portion 46*a*. In a similar manner, the cover 26 has a pleat 48 formed by inward folding to line 50 and the pleat is held at top seam 51 and at the edge 38. Outside open edge 52 of the pleat is stitched at seam 53 and carries a plurality of spaced snap members 54 each of which consists of female portion 54*a* receiving a male portion 54*b* which is attached to cover 26 below portion 54*a*. Adjacent cover edges 32 and 36 carry, for example, zipper elements 60*a* and 60*b*, respectively, for closing the front of the jacket. Also, edges 33 and 37 contain, for example, a plurality of tie openings 33*a* and 37*a*, respectively, for receiving tie cords 61 and 62, respectively. Back panels 14 and 15 have chambers 65 and 66, respectively, which are formed by inside cover 67 and outside cover 68, the cover being stitched together at seam 69 to form the two chambers. Also, the covers are stitched together at outside edges 70 and 71, at bottom edge 72 and cover 68 is stitched to front covers 18 and 26 by seams 43 and 51, respectively. Also, covers 67 and 68 are secured at curved top edge portion 73. Flotation foam panels 75 and 76 substantially fill the chambers 65 and 66, respectively. Outside edges 70 and and 71 contain a plurality of openings 70*a* and 71*a*, respectively, which receive cords 62 and 61, respectively, and the cords can be pulled, and each cord secured by a standard fastener 96.

Collar 16 is formed of inside and outside covers 80 and 81, respectively (see FIG. 5) which are stitched together at bottom edge 82 and side edges 83 and 84 to form chamber 79. The covers 80 and 81 have a top curved edge portion 85 which is secured to the curved edge portion 73 at the top of the back panels 14 and 15. At the shoulers, the cover 80 is secured to back panel cover 68 at seams 90 and cover 81 is secured to front covers 18 and 26 by seams 43 and 51, respectively. Inside front covers 19 and 27 are continuous at the shoulder with inside back cover 67. Thus, the chamber 79 in collar 16 contains bladder section 91 and is in communication at the shoulder with chambers 17 and 25 in the front panels so that sections 21, 29 and 91 of the U-shaped bladder 22 can all be integrally connected together over the shoulders. The edge 82 of collar 16 carries a plurality of snaps 94 which consist of a female portion 94*a* opposite a male portion 94*b* on back cover 68.

As illustrated by the dashed lines in FIGS. 1 and 2, the leg sections 21 and 29 of the bladder almost fills the chambers 17 and 25 of the front panels 11 and 12, respectively, when the snap portions 46*a* and 54*a* are fastened to snap portions 46*b* and 54*b*, respectively, and the pleats 40 and 48 are completely closed. Also, collar section 91 of the bladder almost completely fills the collar 16 when the snap portions 94*a* and 94*b* are connected. In the deflated condition of the bladder, the vest is the equivalent of the Type III vest and depends for flotation solely upon the foam material panels 20, 28, 75 and 76. The leg section 29 has fastened thereto a standard conduit 98 with a valve 99 for oral inflation of the bladder. With the pleat 48 closed, the conduit and valve are completely covered by the pleat 48 so that they will not interfere with the normal arm movements and will not snag on equipment near the wearer.

Figures 3, 4, 5:
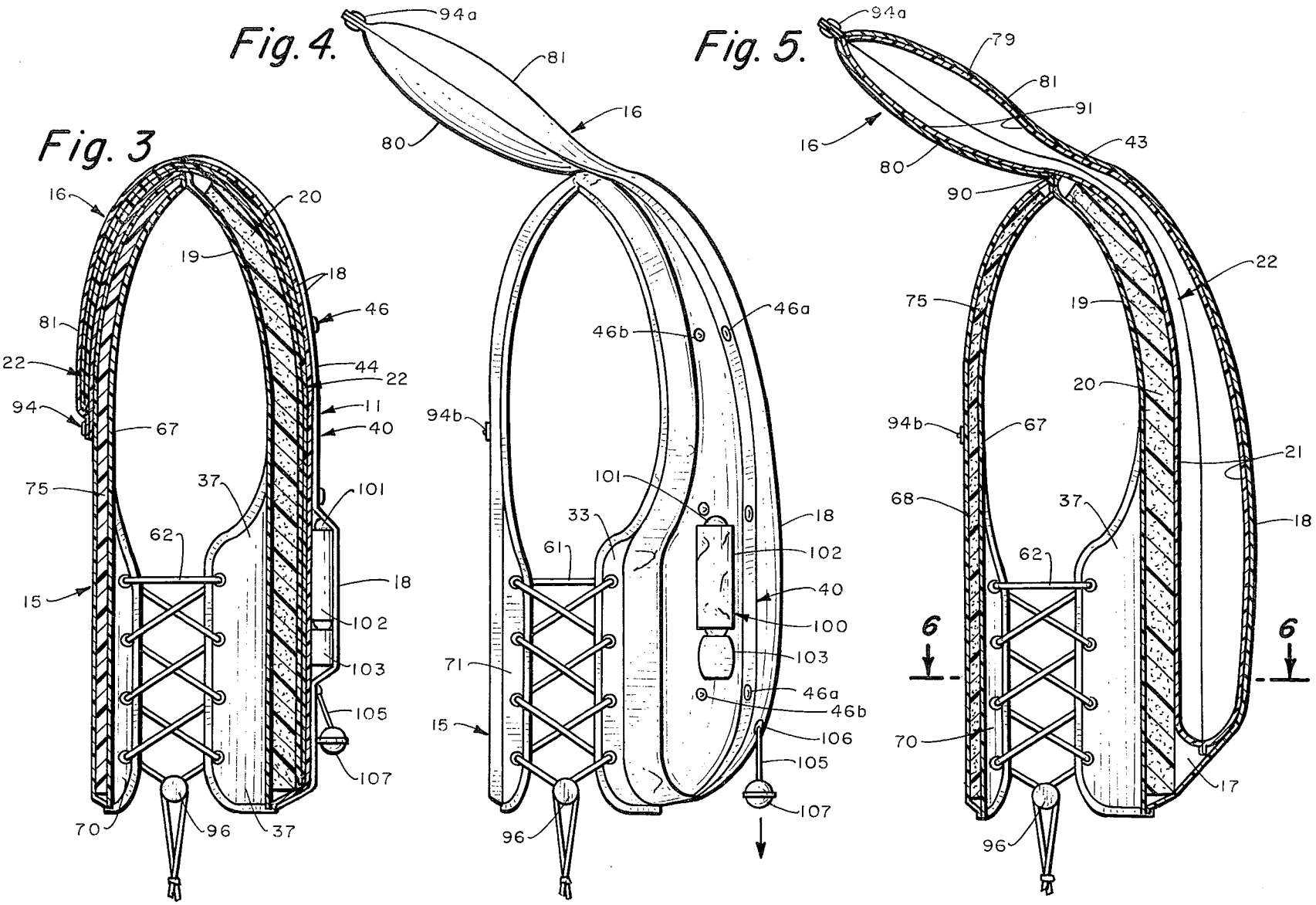
FIG. 3 is a side elevational view along line 3—3 of FIG. 1 showing the vest in the deflated condition and illustrating the bladder located between the foam and the outside chamber cover.
FIG. 4 is a side elevational view similar to FIG. 3 illustrating the jacket in the inflated condition with the snaps unfastened to permit expansion of the front chambers and the collar.
FIG. 5 is a vertical section along line 5—5 of FIG. 1 showing the inflated bladder filling the front chambers and the collar.

The bladder leg section 21 has connected thereto an inflating mechanism 100 consisting of a $CO_2$ cartridge 101 within a sleeve 102 and a standard discharge mechanism 103 having a valve and a lever (not shown) connected to pull cord 105 which extends through eyelet 106 in pleat 40 to knob 107. When the pleat 40 is closed by the snaps, the inflating mechanism is fully covered by the pleat, except for the cord 105 and knob 107 so that the mechanism is out of the way of the wearer and will not interfere with physical motions. A sufficient number of snaps are located on pleats 40, 48 to hold the pleat material close to the front of the vest so that the pleats will not snag on surrounding objects and pulled open unintentionally, which opening would be objectionable to the wearer. As illustrated in FIG. 3, the bladder sections are flat against the covers when the bladder is deflated.

When the wearer desires to obtain additional inflation, bladder 22 can be orally inflated through conduit 98 or can be inflated with $CO_2$ gas by simply pulling on cord 105. Upon inflation, the bladder section 21 and 29 expand with sufficient force to pull the snaps 46 and 54 open and will thereafter expand to pull the covers 18 and 26, respectively, taunt across the front of the vest, as illustrated in FIGS. 5 and 6. In addition, the collar section 91 will expand with sufficient force to pull open the snaps 94 and will thereafter expand and fill the collar 16 and move into substantial alignment with the bladder sections 21 and 29 (see FIG. 5). In this expanded position, the collar 16 raises up under the head of the wearer. Also, because of the inflation of the bladder sections 21 and 29 the major buoyancy force is on the front side of the wearer so that his body will turn over face up and the collar will be underneath the head. Thus, while the vest 10 is basically a Type III device before inflation of the bladder, after inflation the vest performs as well as a Type II personal flotation device in that it will turn an unconscious wearer from a face-down to a face-up position in the water and maintain his head and face out of the water. The pleats allow unrestrained expansion of the bladder sections to allow full inflation of the bladder without restricting movement or manual breathing by the wearer.

A modified vest 101 is shown in FIGS. 7 and 8 wherein like reference numerals refer to like parts as in the previous embodiment, it being understood that the panels of the vest are constructed the same except that the inside bladder 22 is removed. The bladder 22' is located outside rather than inside the covers 18 and 26 on the front panels and outside the cover 68 of the back panel. The bladder 22' has the same shape and size as bladder 22 and has section 21' stitched to cover 18 along inside edges 32, 32*a* only by seam 110. In a similar manner, the bladder section 29' is stitched to cover 26 along inside edges 36, 36*a* only by a continuation of seam 110 which also secures the bladder collar section 91' to the curved top neck edge 85 of the back panels.

A plurality of snaps 111 and 112 are spaced along the unattached edges of bladder sections 21' and 29'. Snaps 111 consist of female portions **111*a* attached to the bladder edge and male portions 111*b* attached to cover 18. Similarly, snaps 112 consist of female portions 112*a* attached to bladder edge and male portion attached to cover 26. The lower edge of the bladder collar section 91' contains a plurality of snaps 114 consisting of a female portion 114*a* attached to the bladder and male section 114*b* attached to cover 68. The bladder 22' has an oral inflation conduit 98' and an inflation mechanism 100', either of which can be utilized to inflate the bladder 22'**.

In the non-inflated condition of the bladder shown in FIG. 7, the bladder is held flat against the vest by snaps 111, 112 and 114. However, upon inflation of the bladder by either oral conduit 98' or mechanism 100', the snaps are unsnapped by the inflation pressure and the bladder assumes the position and shape shown in FIG. 8. The uncovered, unflattened bladder sections will support the wearer in the same manner as the covered inflated bladder of FIGS. 1 and 5.

It is understood that the number and holding strength of the snaps in both modifications is selected so that unsnapping will occur from the inflation pressure. Also, the snaps could be replaced by any other suitable fastening device, such as Velcro tape. Of course, the front zipper can be replaced by snap hooks or buckles and the side cords can be replaced by webbing and dee-rings.

While two inflating devices have been illustrated, either one of the devices could be used without the other for vest inflation.

What is claimed is:

1. In an inflatable, wearable flotation device having two front panels located at the front of the wearer and a back panel located at the back of the wearer, each containing flotation material, the improvement comprising:

an inflatable bladder having two leg sections, one located on each of said front panels, and a collar section located on said back panel;

fastening means for maintaining said bladder flat when fastened;

means for inflating said bladder;

said fastening means being unfastened by the force developed by inflation of said bladder to permit said bladder sections to fully expand;

each of said leg sections being attached to one of said front panels along the inside edge of said leg section and the inside edge of said one front panel; and said fastener means being located along other portions of said leg section.

2. An inflatable, wearable flotation device as defined in claim 1:

said collar section being attached to said back panel at the top edge of said back panel; and said fastening means being located along the bottom edge of said collar section.

3. In an inflatable, wearable flotation device having two front panels and a back panel, each containing flotation material, the improvement comprising:

an inflatable bladder having two leg sections, one located on each of said front panels, and a collar section located on said back panel;

fastening means for maintaining said bladder flat when fastened;

means for inflating said bladder;

said fastening means being unfastened by the force developed by inflation of said bladder to permit said bladder sections to fully expand;

each of said front panels comprising a chamber formed by front and back covers, each of sid chambers containing a leg section of said bladder;

a pleat in the front cover of each of said chambers;

said fastening means being located along the open edge of each of said pleats to close said pleats when fastened; and said fastening means being unfastened by said inflation force to permit said chambers to enlarge and said leg sections to fully expand.

4. In an inflatable, wearable flotation device as defined in claim 3:

a collar having front and back covers forming a collar chamber containing said collar section of said bladder;

said fastening means being located along the bottom edge of said collar to hold said collar against said back panel when fastened; and said fastening means being unfastened by said inflation force to permit said collar section to fully expand.

5. In an inflatable, wearable flotation device as defined in claim 3:

said inflation means comprising an oral inflation tube connected to one of said leg bladder sections in one of said chambers, said inflation tube being fully covered by said pleat in said front cover of said one chamber so as not to interfere with body movement or with external objects.

6. In an inflatable, wearable flotation device as defined in claim 3 wherein said inflation means comprises a gas bottle connected to one of said leg sections in one of said chambers;

a mechanism for connecting said bottle with said one leg section, and a pull cord for operating said mechanism; and said bottle and mechanism being covered by said pleat in said front cover of said one chamber and said pull cord extending through said pleat to be pulled by hand.

7. In an inflatable, wearable flotation device as defined in claim 3:

said fastening means for closing said pleats comprising a first fastening portion secured to the open edge of said pleats and a second fastening portion secured to said one front cover opposite said first fastening portion.

8. In an inflatable, wearable flotation device as defined in claim 4:

said fastening means for holding said collar comprising:

a first fastening portion secured to the bottom edge of said collar; and a second fastening portion secured to said back panel opposite said first fastening portion.

* * * * *